US006945416B2

(12) United States Patent
Manno

(10) Patent No.: US 6,945,416 B2
(45) Date of Patent: Sep. 20, 2005

(54) DEVICE AND A METHOD OF STORING ITEMS

(76) Inventor: Robert C. Manno, 18601 Demion La., Huntington Beach, CA (US) 92646

( * ) Notice: Subject to any disclaimer, the term of this patent is extended or adjusted under 35 U.S.C. 154(b) by 0 days.

(21) Appl. No.: 10/350,163

(22) Filed: Jan. 23, 2003

(65) Prior Publication Data

US 2004/0144745 A1 Jul. 29, 2004

(51) Int. Cl.[7] ..... B65D 1/04; B65D 23/00; B65D 23/02; B65D 23/04

(52) U.S. Cl. ..... 215/10; 215/6; 215/12.2; 206/217; 206/503; 220/23.83

(58) Field of Search ..... 215/12.2, 6, 10; 206/503, 217; 220/23.83

(56) References Cited

U.S. PATENT DOCUMENTS

| | | | | | |
|---|---|---|---|---|---|
| 378,752 | A | * | 2/1888 | Ader | 215/6 |
| 2,576,725 | A | * | 11/1951 | Schoelles | 215/10 |
| 2,687,231 | A | * | 8/1954 | Somers | 206/503 |
| 4,127,207 | A | * | 11/1978 | Hubert et al. | 215/10 |
| 4,308,952 | A | * | 1/1982 | Paulucci | 206/216 |
| 4,603,784 | A | * | 8/1986 | Chang | 215/11.1 |
| 5,120,253 | A | * | 6/1992 | Gelardi | 446/77 |
| 5,301,833 | A | * | 4/1994 | Aycan | 221/96 |
| 5,314,067 | A | * | 5/1994 | Strock | 206/430 |
| D387,852 | S | * | 12/1997 | Radtke et al. | D23/328 |
| 6,382,439 | B1 | * | 5/2002 | Belokin et al. | 215/228 |

FOREIGN PATENT DOCUMENTS

WO WO02/10027 A1 * 2/2002

* cited by examiner

*Primary Examiner*—Sue A. Weaver
(74) *Attorney, Agent, or Firm*—John J. Connors; Connors & Assoc. Inc.

(57) ABSTRACT

An item is stored by placing the item within an opaque sleeve with opposed open ends and inserting into each of the open ends a bottle holding a consumable liquid. The bottles fit snug within the sleeve and each bottle is independently removable from the sleeve and reinsertable therein.

12 Claims, 2 Drawing Sheets

DEVICE AND A METHOD OF STORING ITEMS

INCORPORATION BY REFERENCE

Applicant incorporates herein by reference any and all U.S. patents, U.S. patent applications, and other documents cited or referred to in this application or cited or referred to in the U.S. patents and U.S. patent applications incorporated herein by reference.

DEFINITIONS

The words "comprising", "having", and "including", and other forms thereof, are intended to be equivalent in meaning and be open ended in that an item or items following any one of these words is not meant to be an exhaustive listing of such item or items, or meant to be limited to only the listed item or items.

BACKGROUND OF INVENTION

It is known to make storage devices from common household items such a coffee cans, bottles, and other types of containers in widespread use. California Security Cans is a company that manufactures such devices.

SUMMARY OF INVENTION

This invention, with its several desirable features, is summarized in the CLAIMS that follow. After reading the following section entitled "DETAILED DESCRIPTION OF SOME EMBODIMENTS OF THIS INVENTION", one will understand how the features of this invention provide its benefits. These benefits include, but are not limited to: low cost manufacture, convenience of use, a device appearing to be a single, unitary bottle but including an accessible space, and the ability to hide items within the accessible space, or utilize this accessible space for other purposes.

Without limiting the scope of this invention as expressed by the claims that follow, some, but not all, of its features are:

One, the device of this invention uses a pair of bottles, each holding a liquid suitable for human consumption, and each having a top with a removable cap and a closed bottom. These bottles each have substantially identical cross-sectional configurations. Typically, these bottles are made from a plastic, for example, poly(ethylene terephthalate) and may be transparent, translucent, or opaque. A sleeve of tubular configuration is a retainer for the bottles and it also is made of plastic.

Two, the bottles are inserted into opposed open ends of the sleeve. The one bottle is positioned within one end of the sleeve with its bottom within the interior of the sleeve and its top extending outward from this one end. The other bottle is positioned within the other end of the sleeve with its top within the interior of the sleeve and its bottom extending outward from this other end. The bottom of the one bottle is spaced apart from the top of the second bottle to provide a space that may be used of different purposes. For example, an item may be stored in this space.

Three, the sleeve has a cross-sectional configuration substantially identical to the cross-sectional configurations of the bottles. Consequently, the bottles fix snug within the sleeve but may be removed independently of each other and reinserted after consuming some or all of the liquid within the bottle. The sleeve may be made from a plastic and may be transparent, translucent, or opaque. If made from a transparent material and the device is used to store items, particularly valuable items, the sleeve is opaque. Opaqueness may be achieved by making the sleeve from an opaque material. If a transparent material is used to make the sleeve, then the sleeve's exterior surface is covered with an opaque material, for example, a label that covers substantially the entire sleeve surface.

Four, optionally a pair of stop members are employed that limit the distance the bottles may be inserted within the sleeve. The stop members may comprise an outward projecting element on a sidewall of each bottle between the top and bottom of each bottle. Or, the stop members may be an outward projecting element on an internal surface of the sleeve near each end of the sleeve.

These features are not listed in any rank order nor is this list intended to be exhaustive.

This invention also includes a method of storing an item. It comprises placing the item within an opaque sleeve with opposed open ends and inserting into each of the open ends a bottle holding a consumable liquid. The bottles fit snug within the sleeve, and each bottle is independently removable from the sleeve and reinsertable therein.

DESCRIPTION OF DRAWING

Some embodiments of this invention, illustrating all its features, will now be discussed in detail. These embodiments depict the novel and non-obvious device and method of this invention as shown in the accompanying drawing, which is for illustrative purposes only. This drawing includes the following figures (FIGS.), with like numerals indicating like parts.

DETAILED DESCRIPTION OF SOME EMBODIMENTS OF THIS INVENTION

Figure 1:
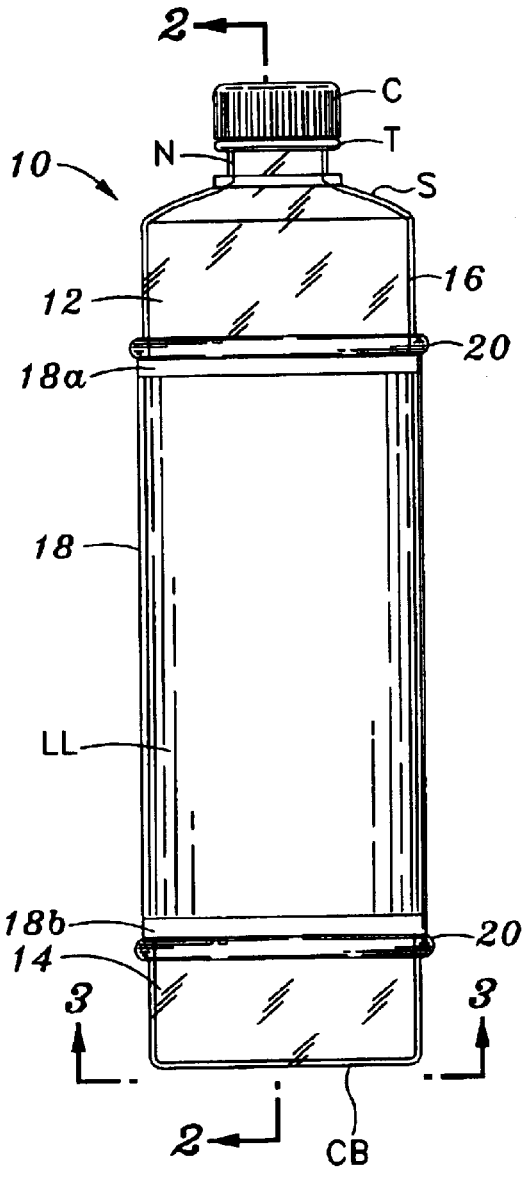
FIG. 1 is a side elevational view of a first embodiment of the device of this invention.
Figure 2:
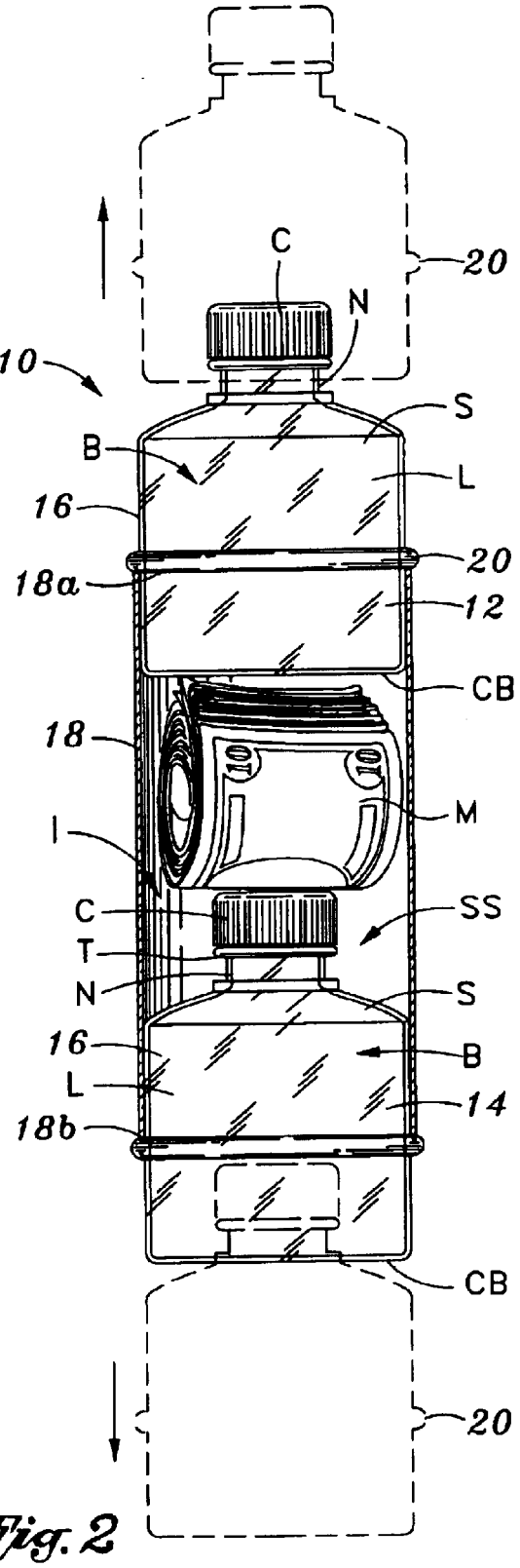
FIG. 2 is a cross-sectional view taken along line 2—2 of FIG. 1.

As depicted in FIGS. 1 and 2, a first embodiment of this invention, the device 10, includes a pair of bottles 12 and 14, typically holding a consumable liquid L such as soda, juice, water, etc. The bottles 12 and 14 each have substantially identical cross-sectional configurations. In this example, each bottle 12 and 14 is generally cylindrically shaped with a circular cross-section of substantially the same diameter. Normally, each bottle 12 and 14 has a diameter from about 3 to about 4 inches and a length from about 3 to about 4.5 inches. The bottles 12 and 14 may be made by conventional blow molding techniques from a transparent, translucent, or opaque material such as for example, a plastic such a polyethylene or polypropylene.

In accordance with the method of this invention, a user places a item such as money M (FIG. 2) within an opaque sleeve 18. The sleeve 18 is of tubular construction with a hollow interior I and opposed open ends 18*a* and 18*b*. The user inserts into each of these open ends 18*a* and 18*b* one of the bottles 12 and 14, storing the item within the interior I of the sleeve 18 between the bottles 12 and 14. The sleeve 18 has a cross-sectional configuration substantially identical to the dimensions and shape of the cross-sectional configurations of the bottles 12 and 14. Thus, the bottles 12 and 14 fit snug within the sleeve 18. Each bottle 12 and 14 is independently removable as shown in dotted lines in FIG. 2 from the sleeve 18. One or both of the bottles 12 and 14 may be removed to access the interior I of the sleeve 18 and then reinserted therein.

The sleeve 18 usually has a diameter from about 3 to about 4 inches and a length from about 5 to about 7 inches. It may be made of an opaque material. Alternately, the sleeve 18 may be made of a transparent material and substantially its exterior surface is covered with an opaque label LL. Even when the bottles 12 and 14 are made of a transparent material and the consumable liquid L is water, light reflects in such a manner as to prevent an observer from seeing the item stored in the device 10.

In this example, the cross-sectional configurations of the bottles 12 and 14 and sleeve 18 are circular. Other cross-sectional shapes such as square, hexagonal, octagonal, etc. may be employed, but circular is the most desirable because the bottles will not have to be especially oriented to achieve registration with the open ends 18*a* and 18*b* of the sleeve 18. When the bottles and sleeve have the same, but other than circular cross-sectional configurations (square, hexagonal, octagonal, etc.), the bottles must be oriented to in order for the perimeters of the sleeve and bottles to be in registration.

Figure 3:
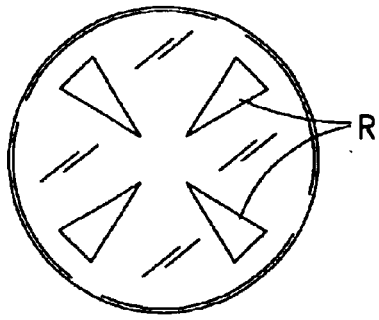
FIG. 3 is an end view taken along line 3—3 of FIG. 1.

Each bottle 12 and 14 has a body B with a closed bottom CB an annular shoulder S from which a neck N extends and forms a top T with a removable cap C. Optionally, as shown in FIG. 3, the bottoms CB of each bottle 12 and 14 have radial, reinforcing ridges R. A sidewall 16 connects the top T and bottom CB of each bottle 12 and 14. About mid-way between each top T and bottom CB on the exterior of the sidewall 16 of each bottle 12 and 14 is an outwardly projecting, circumferential annular member 20. These members 20 act as stops that limit the distance the bottles 12 and 14 may be inserted within the sleeve 16 so that the bottom CB of the bottle 12 is spaced apart from the top T of the bottle 14 to provide a storage space SS in which the item, i.e., the money M, may be stored. The bottle 12 is positioned within the open end 18*a* of the sleeve 18 with its bottom CB within the interior I of the sleeve 18 and its top T extending outward from the one open end 18*a*. The bottle 14 is positioned within the open end 18*b* of the sleeve 18 with its top T within the interior I of the sleeve 18 and its bottom CB extending outward from the open end 18*b*. The bottom CB of the bottle 12 is spaced apart from the top T of the bottle 14 a distance from about 2 to about 3 inches. In accordance with one feature of this invention, the assembly of the bottles 12 and 14 and the sleeve 18 give the appearance of a single bottle holding a consumable liquid.

Figure 4:
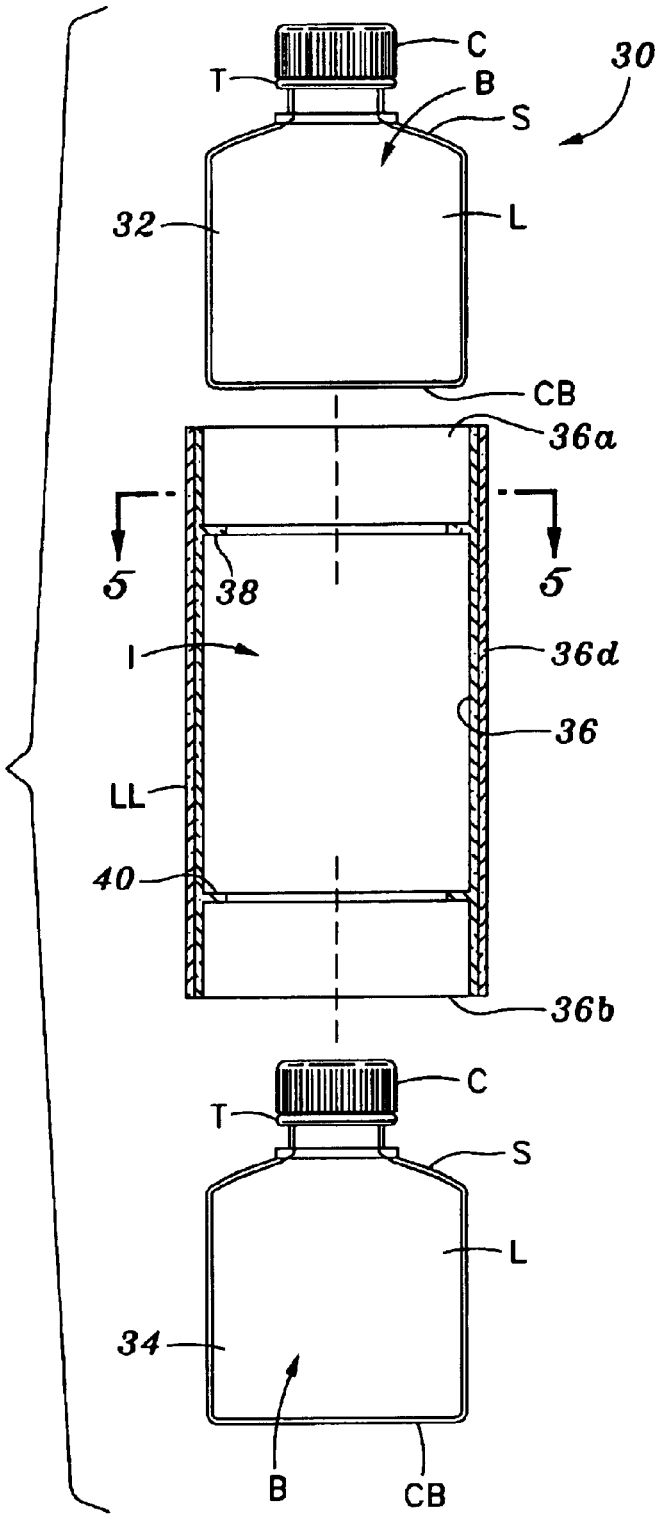
FIG. 4 is a side elevational view, partially in cross-section, of a second embodiment of the device of this invention.
Figure 5:
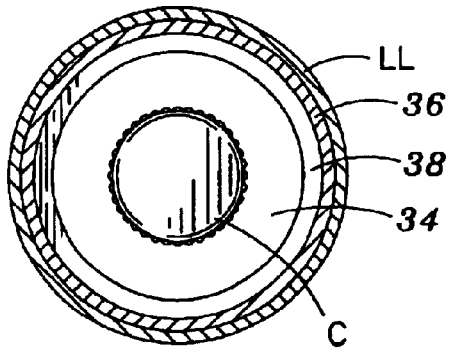
FIG. 5 is a cross-sectional view taken along line 5—5 of FIG. 4.

FIGS. 4 and 5 illustrate a second embodiment of this invention, the storage device 30 that differs from the first embodiment mainly in using stop members within a tubular, cylindrical sleeve 36 instead of stop members 20 on the bottles 12 and 14. The device 30 includes the sleeve 36 and a pair of generally cylindrical bottles 32 and 34 holding a consumable liquid L. The bottles 32 and 34 are respectively inserted into opposed open ends 36*a* and 36*b* of the sleeve 36, fitting snug with these open ends but removable therefrom. There are internal circumferential annular members 38 and 40 respectively near each end 36*a* and 36*b* of the sleeve 36 that are integral with the sidewall 36*d* of the sleeve 36 and project inward into the interior I of the sleeve 36. These annular members 38 and 40 act as stop members. When the bottle 32 is inserted into the open end 36*a*, its closed bottom CB engages the annular member 38, limiting this bottle's movement into the interior I of the sleeve 36 so that its top T projects outward from the end 36*a*. When the bottle 34 is inserted into the open end 36*b*, this bottle's shoulder S engages the annular member 40, limiting this bottle's movement into the interior I of the sleeve 36 so that its closed bottom CB projects outward from the end 36*b*. As with the first embodiment, the bottom CB of the bottle 34 within the sleeve 36 is spaced from the top T of the bottle 34 within the sleeve 36 to create a storage space SS for items.

The first embodiment has an advantage over the second embodiment in that the sleeve 18 is a tubular member extruded from a plastic material, thereby being of lower cost than the sleeve 36. The stop members 20 in the bottles 12 and 14, being formed during blow molding of the plastic material, are not anymore costly than conventional bottles without such stop members.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary the intention is to cover all modifications and alternate constructions coming within the spirit and scope of the invention as generally expressed by the following claims, which particularly point out and distinctly claim the subject matter of the invention.

What is claimed is:

1. A device comprising a first bottle holding a consumable liquid having a top with a removable cap and a closed bottom, a second bottle holding a consumable liquid having a top with a removable cap and a closed bottom, said first and second bottles each having substantially identical cross-sectional configurations, and a sleeve with a opposed open ends providing access to an interior of the sleeve, said sleeve having a cross-sectional configuration substantially identical to the cross-sectional configurations of the bottles, said first bottle being positioned within one of said open ends of the sleeve with the bottom of the first bottle being within the interior of the sleeve and the top of the first bottle extending outward from said one open end, and said second bottle being positioned within the other of said open ends of the sleeve with the top of the second bottle being within the interior of the sleeve and the bottom of the second bottle extending outward from said other open end, said first and second bottles each being independently removable from the sleeve and reinsertable therein, the bottom of the first bottle is spaced apart from the top of the second bottle by at least 2 inches to provide a space in which an item may be stored, and a pair of stop members that limit the distance the first and second bottles may be inserted within the sleeve.

2. The device of claim 1 where the stop members comprise an outward projecting element on a sidewall of each bottle between the top and bottom of each bottle.

3. The device of claim 1 where the stop members comprise an outward projecting element on an internal surface of the sleeve near each end of the sleeve.

4. The device of claim 1 where the bottles and sleeve have a substantially circular cross-sectional configuration.

5. The device of claim 1 where the consumable liquid is water.

6. A device comprising a first bottle holding a consumable liquid having a top with a removable cap and a closed bottom, a second bottle holding a consumable liquid having a top with a removable cap and a closed bottom, said first and second bottles each having substantially identical cross-sectional configurations, and a sleeve with a opposed open ends providing access to an interior of the sleeve, said sleeve having a cross-sectional configuration substantially identical to the cross-sectional configurations of the bottles, said first bottle being positioned within one of said open ends of the sleeve with the bottom of the first bottle being within the interior of the sleeve and the top of the first bottle extending outward from said one open end, and said second bottle being positioned within the other of said open ends of the sleeve with the top of the second bottle being within the interior of the sleeve and the bottom of the second bottle extending outward from said other open end, said first and second bottles each being independently removable from the sleeve and reinsertable therein, where each bottle has a diameter from 3 to 4 inches and a length from 3 to 4.5 inches and the sleeve has a diameter from 3 to 4 inches and a length from 5 to 7 inches.

7. The device of claim 6 where the bottom of the first bottle is spaced apart from the top of the second bottle a distance from 2 to 3 inches.

8. A device comprising a first bottle holding a consumable liquid having a top with a removable cap and a closed bottom, a second bottle holding a consumable liquid having a top with a removable cap and a closed bottom, said first and second bottles each having substantially identical cross-sectional configurations, and an opaque sleeve with a opposed open ends providing access to an interior of the sleeve, said sleeve having a cross-sectional configuration substantially identical to the cross-sectional configurations of the bottles, said first bottle being positioned within one of said open ends of the sleeve with the bottom of the first bottle being within the interior of the sleeve and the top of the first bottle extending outward from said one open end, said second bottle being position within the other of said open ends of the sleeve with the top of the second bottle being within the interior of the sleeve and the bottom of the second bottle extending outward from said other open end, said bottom of the first bottle being spaced apart from the top of the second bottle to provide a space and said first and second bottle each being independently removable from the sleeve and reinsertable therein, and a stop member for each bottle that limits the distance the first and second bottles may be inserted within the sleeve so that the bottom of the first bottle is spaced apart from the top of the second bottle by at least 2 inches to provide a space in which an item may be stored.

9. The device of claim 8 where the stop member for each bottle comprises an outward projecting element on a sidewall of on each bottle between the top and bottom of each bottle.

10. The device of claim 8 where the top members comprise an outward projecting element on an internal surface of the sleeve near each end of the sleeve.

11. A method of storing an item comprising providing an opaque sleeve with opposed open ends, said sleeve having a predetermined cross-sectional configuration, placing the item to be stored within the sleeve between a first bottle holding a consumable liquid that is partially inserted into one open end of the sleeve and a second bottle holding a consumable liquid that is partially inserted into the other open end of the sleeve, each bottle having a cross-sectional configuration substantially identical to said predetermined cross-sectional configuration of the sleeve, said first bottle having a top portion that extends from the one end of the sleeve and the second bottle having a bottom portion that extends from the other end of the sleeve, where each bottle has a diameter from 3 to 4 inches and a length from 3 to 4.5 inches and the sleeve has a diameter from 3 to 4 inches and a length from 5 to 7 inches.

12. A device comprising a first and second bottles each having substantially identical cross-sectional configurations and each including a stop member comprising an outward projecting element on a sidewall of each bottle between a top and a bottom of each bottle, a sleeve with opposed open ends providing access to an interior of the sleeve, said sleeve having a cross-sectional configuration substantially identical to the cross-sectional configurations of the bottles, said first bottle being positioned within one of said open ends of the sleeve with the bottom of the first bottle being within the interior of the sleeve, the top of the first bottle extending outward from said one open end, and the stop member of the first bottle engaging said one open end, said second bottle being positioned within the other of said open ends of the sleeve with the top of the second bottle being within the interior of the sleeve, the bottom of the second bottle extending outward from said other open end, and the stop member of the second bottle engaging said other open end, said first and second bottles each being independently removable from the sleeve and reinsertable therein, said top of the second bottle being maintained spaced a distance of at least 2 inches from the bottom of the first bottle when both said bottles are inserted into the sleeve to provide a storage space in which an item may be stored, where each bottle has a diameter from 3 to 4 inches and a length from 3 to 4.5 inches and the sleeve has a diameter from 3 to 4 inches and a length from 5 to 7 inches.

* * * * *